US006126500A

United States Patent [19]

Bell

[11] Patent Number: 6,126,500

[45] Date of Patent: Oct. 3, 2000

[54] OAR HANDLE

[76] Inventor: Edward Joseph Bell, 1107 Old School Rd., Quakertown, Pa. 18951

[21] Appl. No.: 09/084,851

[22] Filed: May 26, 1998

[51] Int. Cl.[7] ..... B63H 16/04

[52] U.S. Cl. ..... 440/101; 440/102

[58] Field of Search ..... 440/101, 104, 440/105, 102; 416/74

[56] References Cited

U.S. PATENT DOCUMENTS

| | | | |
|---|---|---|---|
| 540,579 | 6/1895 | Davis | 440/102 |
| 3,970,032 | 7/1976 | Phillips | 440/101 |

*Primary Examiner*—Sherman Basinger
*Attorney, Agent, or Firm*—William H. Eilberg

[57] ABSTRACT

An oar handle is used in sweep rowing. Sweep rowing is when a single oar is pulled by both hands of a single rower. The oar handle has a support which at one end can be secured to the end of the shaft of a sweep rowing oar. A handle bar having a pair of hand grips at its opposite ends is mounted at its center to the opposite end of the support. The handle bar is mounted to the support so that it is free to rotate on the support about a pivot point in the center of the handle bar. The pivot point is aligned with the central axis of the support. When the oar handle is mounted on the shaft of an oar with its central axis in alignment with the central axis of the oar, the pivot point is likewise aligned with the central axis of the oar. In use, a rower grips each one of the hand grips with one of his hands. As the rower pulls the oar, the handle bar rotates relative to the central axis of the oar, allowing the rower to pull equally with both of his arms and his body. The power of the rowing stroke is transferred from the pivot point of the handle bar to the oar along the central axis of the oar.

4 Claims, 4 Drawing Sheets

OAR HANDLE

This invention relates to an oar handle and more particularly is concerned with an oar handle for oars of the type used in sweep rowing.

BACKGROUND OF THE INVENTION

Rowing is a very old, well developed sport that is engaged in around the world. There is competitive rowing at the high school level, at the college and university level and in private rowing clubs. Rowing has been a recognized sport at the Olympic level since 1896 with essentially all countries now participating in Olympic rowing competition.

Intense scientific research and development has been conducted on the design and development of the boats, oars, oarlocks and other equipment used in rowing to improve the performance of the rowers and the speed of the boats used in competitive rowing. The shapes of the hulls of the boats, for example, have been refined many times to try to reach the ultimate configuration for speed. The shape of the oar blade has likewise been changed to match a particular crew preference, water and wind conditions and the like. Some of the changes in equipment have made a marked improvement in the performance of the rowers such as the invention of the sliding seat for the rowers. Others have made slight but important improvements that can result in winning close races.

A notable exception to the ongoing improvements in the equipment for rowing is the handle of the oar. The overall shape of the oar handle currently used is the same as it has been since time immemorial, namely, an elongated round cylinder. Oar handles have been made of different materials than the traditional wood, and have been made adjustable so the total length of the oar can be changed. But the changes have at best been very slight.

Competitive rowing can be broadly divided into two types, sculling and sweep rowing. There is significant difference in the method of rowing when sculling as compared to when sweep rowing. These differences result in a marked difference in the balance of the rowing stroke and the physical effects of rowing on the rowers.

When sculling, an individual rower holds a matched pair of oars with one of the oars on the starboard side and the other on the port side of the boat. At the start of the rowing stroke, the rower, who is facing backwards and sitting on a sliding seat, moves forward, holds the handles of each oar with his hands and extends both arms fully toward the stern of the boat. The oars pivot in their respective oarlocks and the blade of the oar extends toward the bow of the boat. The rower simultaneously pulls both oars keeping his arms straight and his body in alignment with the keel of the boat. The rower leans backwards, equally using the muscles of his torso and both legs to pull the oars toward him. During the stroke he slides toward the bow while remaining in alignment with the keel of the boat. The arms of the rower remain parallel to the keel of the boat. The line of the shoulders remains essentially perpendicular to the keel. Toward the end of the stroke, when the rower's body and legs are almost fully extended, the rower bends his elbows and pulls the oars toward his chest to complete the stroke. Sculling results in a very balanced rowing stroke.

Sweep rowing is different from sculling both in the method of pulling the oars and, in particular, in the relative lack of balance and the physical strains placed on the rowers. Using a conventional sweep oar, both hands are positioned on a cylindrical handle of a single oar. At the start of the stroke the rower leans forward and twists his upper body, and in particular his shoulders, outwardly at an angle to the keel line. The oar is held at an acute angle to the keel of the boat. Because of the relative angle of the oar to the keel, the arm most distant from the oar is fully stretched while the arm closest to the oarlock is bent at the elbow to compensate for the different distances of the rower's torso from the oar. As the oar is pulled the rower twists his upper body to align it with the line of the keel as he completes his stroke. In addition, the oar is held at an angle with respect to the water which causes the shoulder furthest from the oarlock to be higher than the shoulder nearest the oarlock. Because of the relative position of the oar and the body of the rower, the arm most distant from the oarlock is principally used to complete the stroke until almost the end of the stroke.

The inherent imbalance of sweep rowing causes a number of long recognized problems. The movement of the rower's body out of alignment with the keel at the start of each stroke can cause the boat to go out of balance or even turn the boat. Pairs of rowers with one rower on each side of the boat are used to compensate for this problem when sweep rowing. In theory this should correct the problem but in practice, rowers are rarely perfectly matched in weight and strength so as to balance each other.

A significant difference between sculling and sweep rowing is that if all other factors are equal, such as the size of the boat, the number of rowers and the weight and experience of the rowers, a boat that is sculled will inherently be faster than a boat which is sweep rowed. The reason for this has not previously been fully understood. In addition, experienced scullers can row a sweep rowed boat and be reasonably effective. On the other hand, experienced sweep rowers cannot generally make an occasional transition to a scull rowed boat and be effective. Sweep rowers have problems in maintaining the inherent balance of sculling noted above.

Another problem encountered when sweep rowing is that the physical imbalances in the use of the body's muscles cause physical damage to the bodies of sweep rowers. The leg muscles of the leg closest to the oarlock, and the muscles of the side of the back and the arm away from the oarlock are primarily used to pull the oar in sweep rowing. This isometric method of pulling the oar in sweep rowing places unbalanced stresses on the entire body of the rower. Persons who sweep row competitively typically develop their rowing muscles asymmetrically and as a result there is an unhealthy imbalance in the muscle development from one side of the body to the other. Competitive rowers, as they start to develop, have to select to row on the starboard or port side of the boat because of the imbalance in their muscle development. The imbalances encountered in sweep rowing have resulted in competitive rowers training to change their bodies to compensate for the problems inherent in conventional sweep rowing equipment.

The problems of the imbalance in muscle development and the stresses placed on the sweep rower's body are well known. Authorities on rowing, such as Dr. Earnest Herberger in his book "Rowing" suggest that the training and development of rowers should start in the early teenage years but the rowing should be strictly limited to sculling to prevent permanent damage to the spine and back muscles of a rower until the body's bone structure is fully developed in the late teens or early twenties.

Another important disadvantage encountered in competitive conventional sweep rowing is that there is inherently more fatigue of the rowers, especially during periods of maximum output as compared to sculling. This again is believed to be due to the asymmetric use of the body muscles in sweep rowing where only certain muscles do most of the work as compared to sculling where there is a much more balanced use of the body's muscles.

What would be highly advantageous would be equipment improvements in the apparatus used for sweep rowing, to improve the balance of the rowing stroke by rowers, and to decrease the adverse physical effects of sweep rowing on the rower's body. It would also be advantageous if the speed of sweep rowed boats could be increased along with a reduction in the adverse effects of sweep rowing on the body of the rowers.

SUMMARY OF THE INVENTION

An oar handle for a sweep rowing oar is disclosed. The oar handle is comprised of a support member and a handle bar member. The handle bar member has a pair of spaced apart hand holds and is mounted to the support member so that it rotates about a pivot point. The pivot point about which the handle bar member rotates is aligned with the central axis of the support member. When the oar handle is mounted on an oar with its central axis in alignment with the central axis of the oar, the pivot point is likewise in alignment with the central axis of the oar. The handle bar member is also preferably mounted at an angle with respect to the central axis of the oar to compensate for the angle of entry of the oar into the water. The support member, in use, is attached to the handle end of the shaft of a sweep oar. In use, the rower grips the hand holds with each of his hands and pulls straight back in alignment with the keel of the boat being rowed. The handle bar member rotates with respect to the central axis of the oar as the oar is pulled, thereby compensating for the difference in distance of the oar from the rower's body. The use of the oar handle of this invention results in a more balanced stroke using a sweep oar and less physical stress on the rower's body.

DETAILED DESCRIPTION OF THE INVENTION

Figure 1:
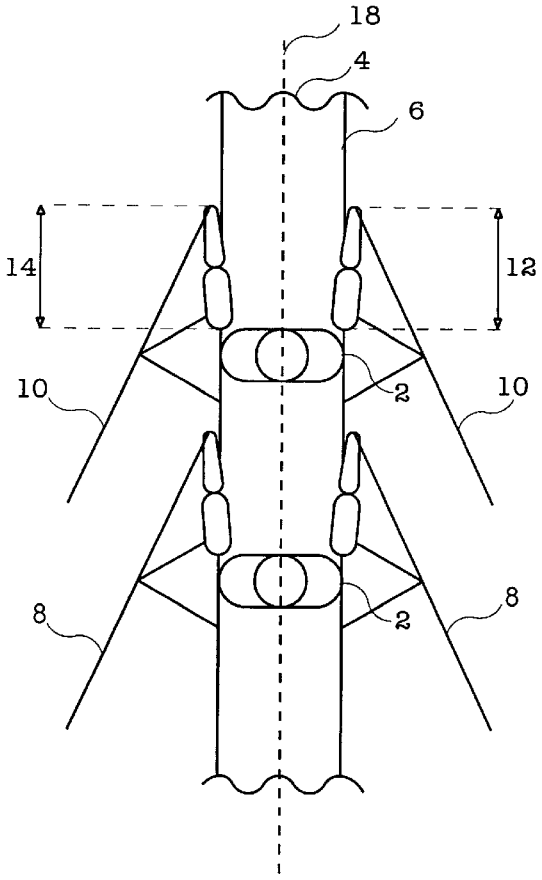
Fig. 1 (prior art)
FIG. 1 is a schematic illustration showing the relative positions of a pair of rowers when sculling a boat to the keel alignment of the boat and the oars.

In FIG. 1 there is shown the typical position of rowers 2 when sculling. The rowers 2 sit facing the stern 4 of the boat 6 aligned with the keel 8 of the boat 6. Each rower 2 pulls a pair of sculling oars 10. The distances 12, 14 of the handles of the individual oars 10 from the rowers' 2 bodies are equal. This arrangement of the rowers 2 and the oars 10 in sculling results in a well balanced rowing of the boat 6.

Figure 2:
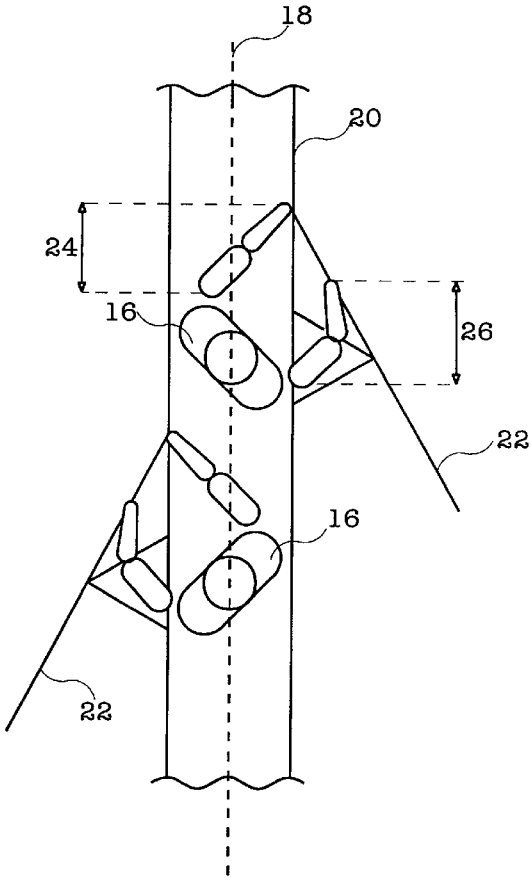
Fig. 2 (prior art)
FIG. 2 is a schematic illustration showing the relative positions of a pair of rowers when sweep rowing a boat to the keel alignment of the boat and the oars.

In sweep rowing as shown in FIG. 2 there is an inherent imbalance in the rowing which must be compensated for by the sweep rowers 16. Each rower 16, when sweep rowing, sits facing the stern 18 of the boat 20 and pulls a single oar 22. Each sweep oar 22 is gripped with both hands with each hand being spaced along the length of the handle of the oar 22. The different distances 24, 26 between the rowers' 16 bodies and the oar 22 are due to the angle of the oar 22 with respect to the keel of the boat 20.

Figure 3:
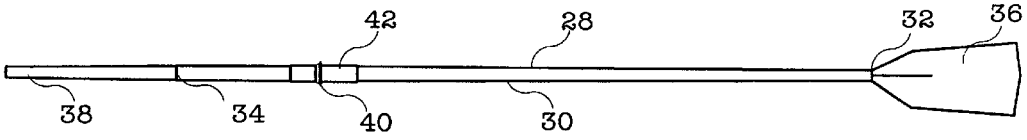
Fig. 3 (prior art)
FIG. 3 is an illustration of a typical prior art oar of the type used in sweep rowing.

As shown in FIG. 3 the typical prior art sweep oar 28 includes an elongated shaft 30 with opposing first and second terminal ends 32, 34. A blade 36 is attached to the first terminal end 32. A handle 38 is attached to the second terminal end 34. A collar 40 and a sleeve 42 are positioned intermediate the first and second terminal ends 32, 34 at a predetermined distance from the terminal ends 32, 34 to fit into an oarlock of the boat. The handle 38, shaft 30 and the blade 36 may be permanently secured to each other but more commonly are removable to allow for adjustment of the oar 28.

Figure 4:
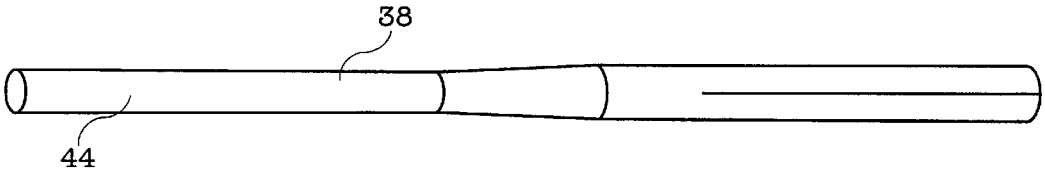
Fig. 4 (prior art)
FIG. 4 is an illustration of a typical prior art oar handle.

As shown in FIG. 4, the conventional prior art oar handles 38 used on sweep oars have a uniform round cylindrical hand grip 44.

Figure 5:
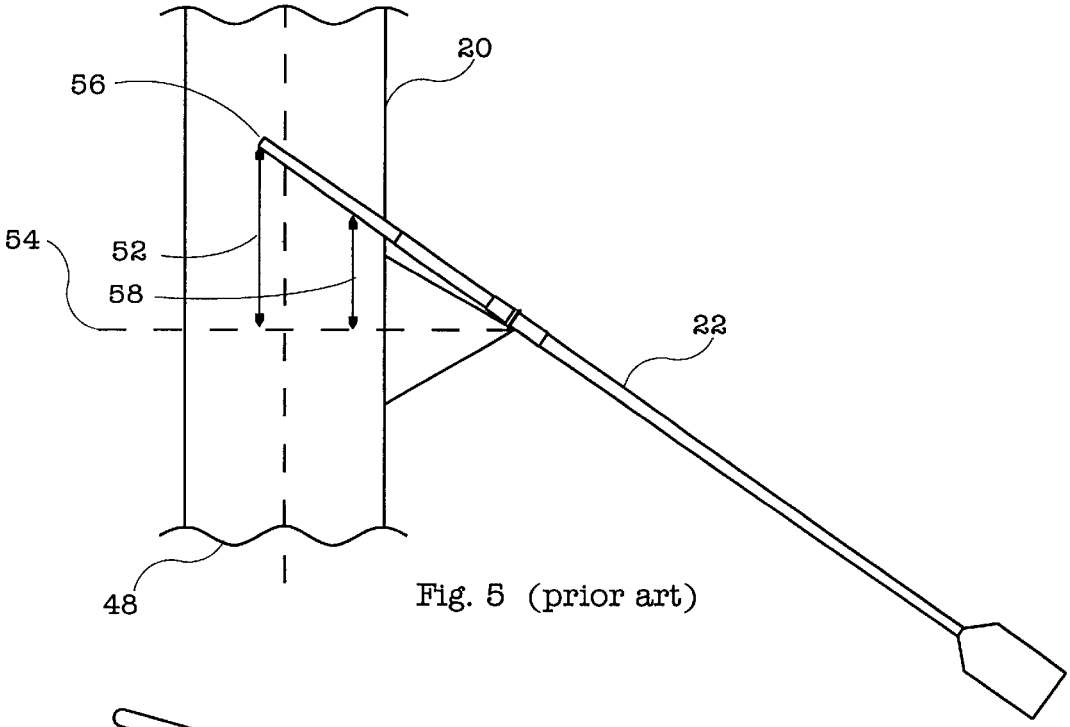
Fig. 5 (prior art)
FIG. 5 is a diagrammatic top view illustration showing the differences in the distance of the handle of an oar from a sweep rower using a conventional prior art oar handle.

As shown in top plan diagrammatic drawing in FIG. 5, at the start of a sweep row stroke the blade end of the sweep oar 22 is pivoted toward the bow 48 of the boat 20 at an acute angle to the keel of the boat. The inboard distance 52 from a line drawn perpendicular to the keel 54 to the point 56 where the inboard hand of the rower grips the oar 22 is longer than the distance 58 from the line drawn perpendicular to the keel to the point where the outboard hand of the rower grips the oar. It is these differences in length 52, 58 that heretofore required the rower to twist his body to compensate at least in part for the differences in length.

Figure 6:
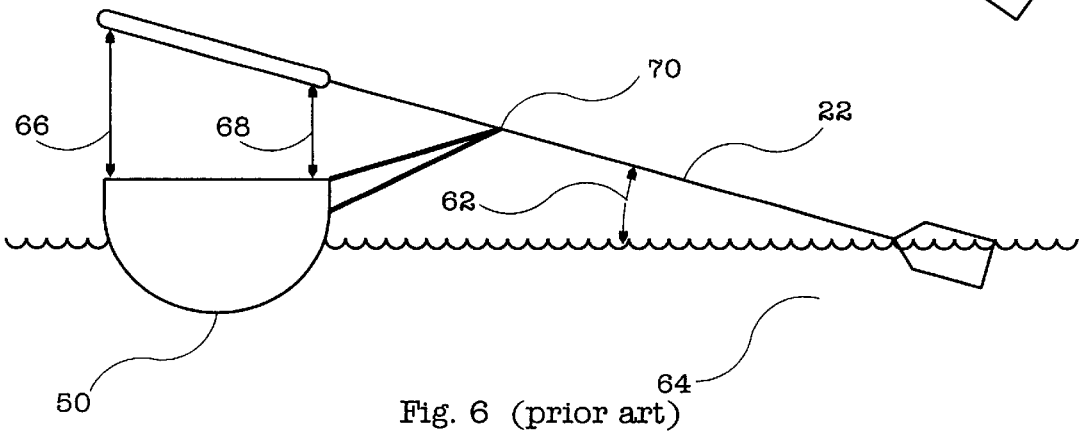
Fig. 6 (prior art)
FIG. 6 is a diagrammatic side view illustration showing the differences in the height of an oar along its length from the oarlock to the keel of a boat using a conventional prior art sweep oar.

Also as shown in the diagrammatic side view of FIG. 6, the angle of entry 62 of the oar 22 into the water 64 results in the height 66 of the oar handle over the keel being greater than the height 68 of the oar handle adjacent the oarlock 70. These differences in heights 66, 68 required a rower to twist his body to compensate for the differences.

Figure 7:
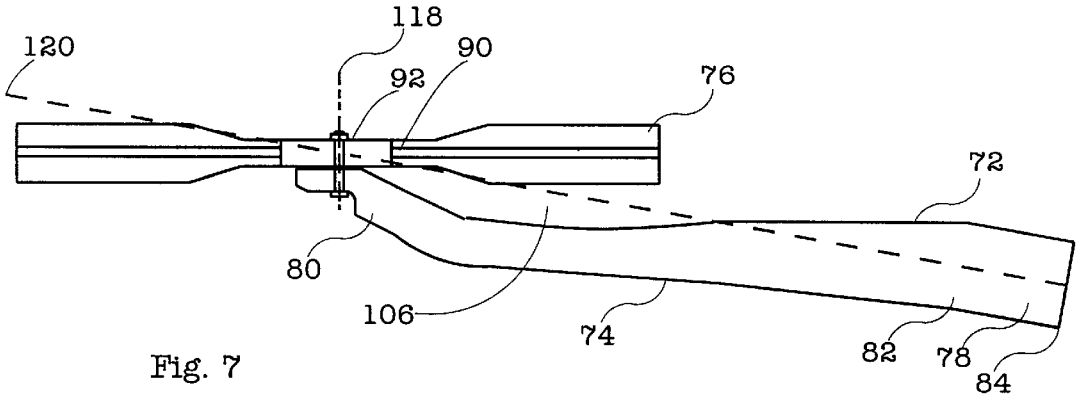
FIG. 7 is an illustration of the oar handle of this invention.

In FIG. 7 there is shown in partial cross-section the preferred embodiment of the oar handle 72 of this invention. The oar handle 72 of this invention is comprised of a shaped elongated support member 74 and handle bar member 76 rotatably mounted to support member 74.

The support member 74 has first and second opposing terminal end portions 78, 80. At the first terminal end 78 there is provided a means 82 for securing the oar handle 72 to a terminal end of the shaft of an oar. In the preferred embodiment of the oar handle 72, the first terminal end portion 78 of the support member 74 is of a right cylindrical shape having an outer diameter 84 which will mate with the inner diameter of a tubular shaft oar on which the handle is to be mounted. The first terminal end 78 of the handle 72 can have other shapes such as being oval, square or dog-bone in cross section to fit into a mating end of an oar shaft. The round cross section end section is easiest to manufacture and can readily be retrofitted onto existing oar shafts which typically have a round end to receive the handle. The other cross sectional ends such as those noted above, however, have the advantage that they inherently will not rotate when inserted into an oar handle having a mating tubular end. The oar handle 72 can be secured to the shaft of an oar by a variety of well known means (not shown) such as screws, bolts, pins, clamps and adhesives.

Figure 8:
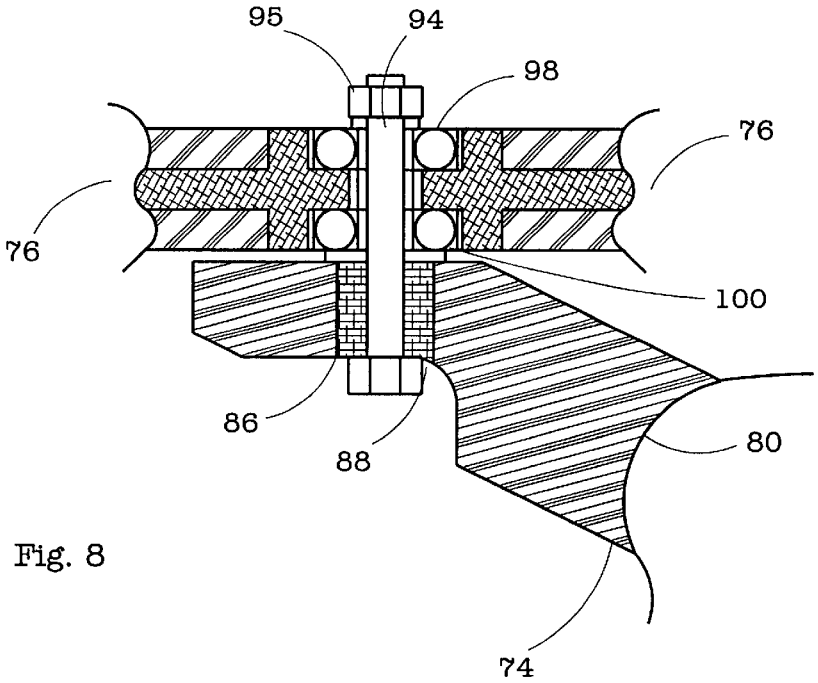
FIG. 8 is an enlarged view, in fragmentary cross section, of a portion of the handle assembly shown in FIG. 7.

The handle bar member 76 is rotatably mounted to the second terminal end portion 80 of the support member 74. Various methods can be used to rotatably secure the handle bar member 76 to the support member 74. One preferred method is shown in FIG. 8. An aperture 86 is formed in the second terminal portion 80 of the support member 74. A removable metal bushing 88, that can be made of, for example, steel, bronze or Teflon, is fitted into the aperture 86 to reinforce and reduce wear of the aperture 86. The handle bar member 76 includes an elongated central bar 90 which extends the length of the handle bar member 76. An aperture 92 is formed in the center of the bar 90. A bolt 94 having a diameter which mates with the inner diameter of the apertures 86, 92 is inserted through the aperture 92 in handle bar member 76 and then the aperture 86 in the support member 74. A nut 95 is screwed on the bolt 94 to secure handle bar member 76 to the support member 74. The nut 95 is preferably on the upper side of the oar handle 72 so as to present a smoother surface on the under side, the side which is most likely to contact the rower in use. Bearings 98, 100 are preferably provided on either side of the handle bar member 76 to facilitate the free rotational movement of the handle bar 76 with respect to the support member 74. Other attachments can be used to rotatably secure the handle bar to the support. In place of the bolt, a boss can be formed on either the handle bar member or the support member and the other part attached to the boss. In addition, other conventional methods can be used, such as a rivet to secure the handle bar member and the support member together.

A pair of opposing hand holds 102, 104 are secured to the central bar 90 equidistant from the center aperture 92 in the central bar 90.

Figure 9:
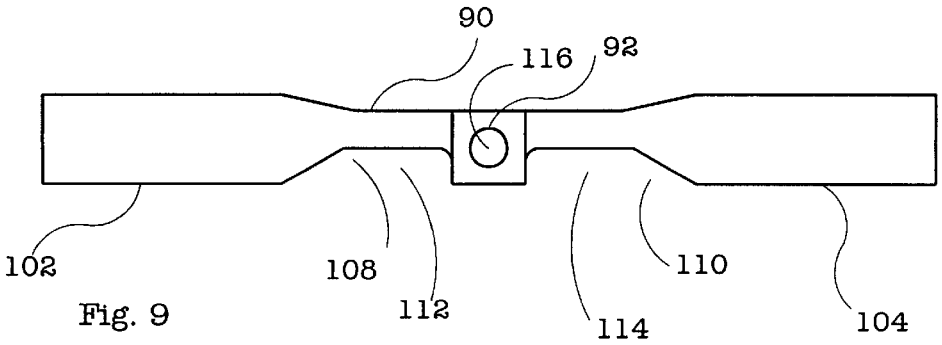
FIG. 9 is a top plan view of the handle bar member shown in FIG. 7.

The second terminal end portion 80 of the support member 74 is preferably shaped to allow clearance 106 for the fingers on the hand of a rower between the support member 74 and the hand holds when using the oar handle 72 of this invention. It is also preferable as shown in FIG. 9 to provide the inside end of the hand holds 102, 104 tapered to better fit the thumbs of the rower.

Figure 10:
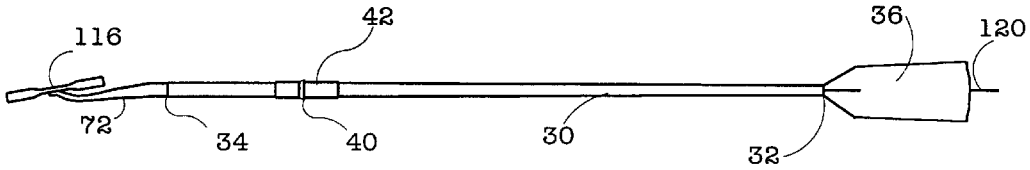
FIG. 10 is an illustration of a sweep oar which includes the oar handle in accordance with this invention.

An important feature of this invention is that pivot point 116 of the axis of rotation 118 (shown as a dotted line) of the handle bar member 76 is aligned with the central axis 120 (shown as a dotted line) of the oar handle 72. The result of this alignment is shown in FIG. 10. When the oar handle 72 of this invention is mounted on a conventional oar shaft, the central axis of the oar shaft 120, the central axis of the handle 72 and the pivot point 116 will be in alignment. This is important in that when rowing, the rowing force must be transmitted along the central axis of the oar to obtain the maximum effectiveness of the stroke. If the pulling force as applied at the oar handle is transferred off center from the central axis of the oar, the oar will be torqued out of its desired position in the water. The positioning of the pivot point in alignment with the central axis in accordance with this invention allows the pulling force to be transferred along the central axis even though the hand holds 102, 104 of the oar handle 72 are not aligned with the central axis 120 of the oar.

An additional feature of the preferred embodiment 72 of this invention, as shown in FIG. 7, is that the handle bar member 76 is mounted at a predetermined angle with respect to the central axis 120. The predetermined angle of the handle bar member 76 to the central axis 120 is selected to compensate for the angle of entry 62 of an oar into the water 64. The exact angle of entry 62 of the oar into the water for a given boat can be varied by selecting the position of the oarlock. This angle of entry 62 typically will be between eight and twelve degrees. It has been found in practice that if the angle of the handle bar 76 relative to the central axis 120 is set at about ten degrees, this is generally satisfactory for almost any situation. It also has been found that it is preferable to make the oar handle 72 with a fixed angle rather than an adjustable angle in that it removes a possible equipment problem when racing. The mounting of the handle bar member at an angle to the central axis 120 to compensate for the angle of entry 62, while certainly preferable, does not have to be used, when practicing this invention. Most of the advantages of this invention can be obtained by rotatably mounting the handle bar member with pivot point 116 in alignment with the central axis 120 of the oar handle as noted above.

The oar handle 72 of this invention can be fabricated from a variety of materials. The material for the support member 74 should be both strong and light. Strength is important because of the considerable pulling force applied at the pivot point 116 of support member 74 during rowing. The support member 74 can, for example, be made from light strong metals such as titanium or tempered aluminum which is machined or cast into the required shape. An additional class of materials that have been found to be suitable are high strength composites such as carbon fiber reinforced epoxy composites. Advantageously, the aperture 86 in the support member 74 should be reinforced with a replaceable metal busing 88 for the bolt 94. When wear does occur, the busing 88 can be replaced rather than the entire support member 74. The central bar 90 of the handle bar member 76 should likewise be made from a strong material such as titanium, tempered aluminum or high strength composites. The hand holds 102, 104 can be made from materials commonly used for oar handles in the prior art such as wood or rubber so as to reduce to a minimum the number of adjustments a rower needs to make to use the oar handle 72 of this invention. The hand holds 102, 104 can also be made of newer materials such as plastic composites and the like.

Referring to FIG. 10, to use the oar handle 72 of this invention the oar handle 72 is secured to one end of an oar shaft and a blade is secured to the opposite end of the shaft. The completed oar is then mounted into the oarlock in the conventional manner. This invention includes both the oar handle by itself which can be used to retrofit the conventional handle on existing oars, and as part of a complete oar comprising the handle of this invention, an oar shaft and a blade.

One of the advantages of this invention is that it does not require any modification of the other rowing equipment. The improvement occurs in the manner in which the boat is rowed. The rower sits on the sliding seat of the boat with both of his arms fully extended and his hands holding their respective hand holds. The rower, using both of his legs and the muscles on both sides of his back equally, pulls on the hand holds, drawing the oar toward his chest as he slides backwards in the seat. During the power part of the stroke, both arms remain straight. At the completion of the stroke, the rower equally pulls his arms in, while bending his elbows. The oar is then feathered by the rower raising one hand and lowering the other hand to twist the oar.

Figure 11:
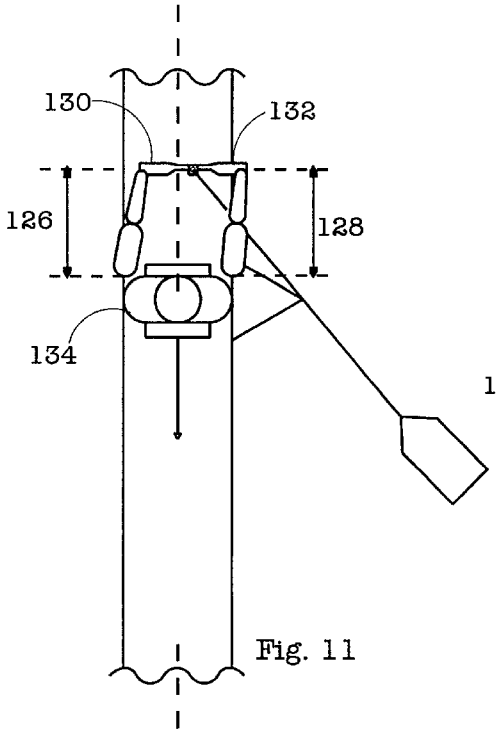
FIGS. 11 and 12 are diagrammatic top plan views showing how rotating the angle of the oar handle of this invention allows a sweep rower to maintain a uniform distance of the handle from his body when the angle of the oar to the keel of the boat is changing during the rowing stroke.
Figure 12:
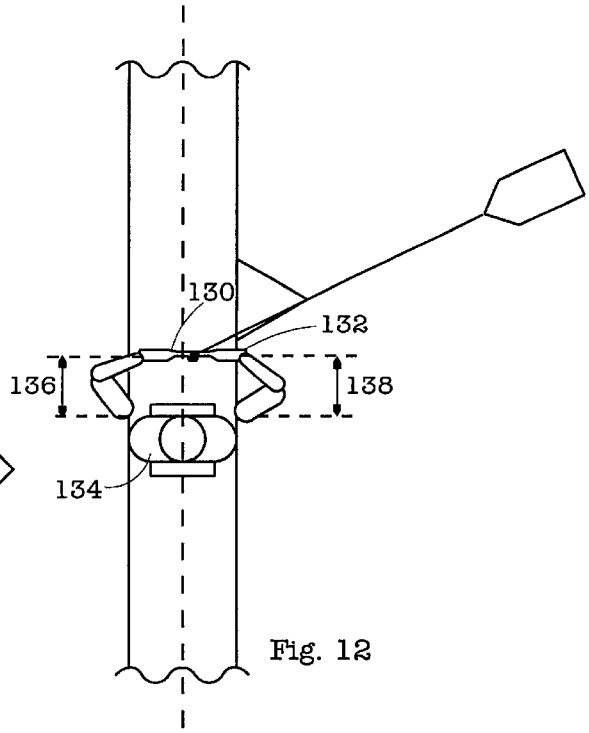
Figure 13:
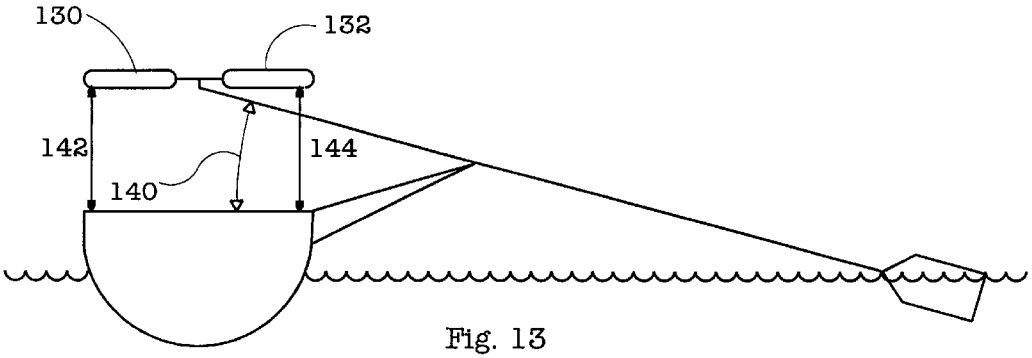
FIG. 13 is a diagrammatic illustration showing how the oar handle of the invention allows the oar handle to be level during the rowing stroke.

The advantages obtained using the oar handle 72 of this invention can be seen in the diagrammatic drawing in FIGS. 11–13. As best seen in FIG. 11, at the start of the rowing stroke the distances 126, 128 between hand holds 130, 132 and both sides of the torso of a rower 134 are the same. At the end of the rowing stroke as seen in FIG. 12 the distances 136, 138 between the hand holds 130, 132 and the rower 134 are shorter but still equal.

The advantage obtained by aligning the oar handle 72 of this invention at an angle to compensate for the angle of entry 140 of the oar into the water is shown in FIG. 13. The oar handle is level, with heights 142, 144 of the hand grip 130, 132 being equal.

The rowing stroke which is used with the oar handle 72 of this invention is almost identical to the stroke used in sculling, with the exception that a single sweep oar is pulled rather than a pair of oars as in sculling.

In evaluation of the oar handle 72 of this invention in comparison with the conventional oar handles previously used in sweep rowing, it was found that the oar handle of this invention 72 is far superior to the prior art oar handles. The rower's stroke is balanced using the oar handle 72 of this invention. The rowers used their muscles symmetrically similar to sculling as opposed to the asymmetrical use of the muscles with the conventional oar handles. This in itself will reduce injuries to sweep rowers for the reason noted above. Younger rowers can now sweep row because of the balance of the stroke using the oar handle 72 of this invention without the danger of physical injury as is the case with conventional sweep rowing. An additional advantage of the oar handle 72 of this invention is that less training is required to become proficient in sweep rowing with oar handle 72 of this invention. Furthermore rowers can row equally well on either the port or starboard side of the boat. The rower no longer has to elect to row on the port or starboard side of a boat and then train his body for rowing on that side only. There also appears to be a noticeable increase in the overall speed of sweep rowed boats using the oar handle 72 of this invention. There are other advantages of the oar handle of this invention that will become more apparent to those skilled in the art after becoming familiar with the use of the oar handle 72.

The invention as shown and described is disclosed in the preferred embodiments. It should be noted that various changes that will become obvious to those skilled in the art are included within the spirit and scope of this invention. The specific shape of the part can be modified such as the support being more curved. The parts can be reversed such as having the handle bar member mounted to the underside of the support rather than on the topside of the support. These and other changes are included within the scope of the subjoined claims.

What is claimed is:

1. An oar handle comprising:

a) an elongated support member, the support member having a distal end comprising means for engaging a body of water, the support member having a proximal end opposite the distal end, the support member having a longitudinal axis, b) a handle bar member, the handle bar member including a pair of hand holds connected by a middle section, and c) attachment means connecting the proximal end of the support member to the middle section of the handle bar member, wherein the attachment means defines an axis of rotation, wherein the axis of rotation of the attachment means is obligue relative to the longitudinal axis of the support member, wherein the attachment means comprises means for permitting the handle bar member to rotate relative to the support member, about said axis of rotation, and wherein the attachment means comprises means for preventing any relative movement of the support member and the handle bar member other than rotation about said axis, wherein the handle bar member can move with exactly one degree of freedom relative to the support member.

2. The oar handle of claim 1, wherein the middle section of the handle bar member includes a first flat surface, and wherein the proximal end of the support member includes a second flat surface, wherein said first and second flat surfaces are held in abutment with each other by the attachment means.

3. The oar handle of claim 2, wherein the attachment means comprises a bolt extending through holes in the support member and the handle bar member.

4. The oar handle of claim 1, wherein the attachment means comprises a bolt extending through holes in the support member and the handle bar member.

* * * * *